US005899756A

United States Patent [19]

Suzuki

[11] Patent Number: 5,899,756

[45] Date of Patent: May 4, 1999

[54] ELECTRICAL CONNECTOR WITH SLIDER

[75] Inventor: Masao Suzuki, Tokyo, Japan

[73] Assignee: Thomas & Betts Corporation, Memphis, Tenn.

[21] Appl. No.: 08/814,139

[22] Filed: Mar. 10, 1997

[51] Int. Cl.[6] ..... H01R 9/09

[52] U.S. Cl. ..... 439/67; 439/83

[58] Field of Search ..... 439/495, 67, 73, 439/492, 499

[56] References Cited

U.S. PATENT DOCUMENTS

| | | | |
|---|---|---|---|
| 3,090,028 | 5/1963 | Hall et al. | 439/495 |
| 4,639,063 | 1/1987 | Mueller | 439/495 |
| 4,948,378 | 8/1990 | Hoshino | 439/495 |

*Primary Examiner*—Khiem Nguyen
*Assistant Examiner*—Eugene G. Byrd
*Attorney, Agent, or Firm*—Hoffmann & Baron, LLP

[57] ABSTRACT

A surface mount connector for a flexible printed circuit board of low profile (low height) by providing contacts at a smaller pitch. A connector comprises an insulator, a plurality of contacts aligned longitudinally of the insulator and a slider. The contacts are provided in the insulator with at least one end thereof and a portion of a central area thereof being exposed outward. The slider holds a flexible printed circuit board between the slider and the insulator, longitudinal opposite ends of the slider are connected to opposite ends of the insulator and the contacts are electrically connected to a conductive pattern of the printed circuit board at positions corresponding to a node of the slider.

7 Claims, 3 Drawing Sheets

ELECTRICAL CONNECTOR WITH SLIDER

FIELD OF THE INVENTION

The present invention relates to a surface mount type connector for a flexible printed circuit board. As a connector which is mounted to a surface of a printed circuit board for connection of other flexible printed circuit board, a slide type or a ZIF (Zero Insertion Force) type has been known.

BACKGROUND OF THE INVENTION

In an electronic equipment such as a mobile telephone set, a demand to further reduce a size is strong and components used therefor are in many cases of smaller size and of high packing density. In a flexible printed circuit board used in such a small size electronic equipment, an electrode (conductive pattern) pitch is narrowed and a contact pitch in a connector for connection with the printed circuit board is also narrowed to increase the package density.

However, in the prior art slide type of ZIF connector, there is a limit in narrowing the contact pitch by a structural reason. Thus, a connector which allows the reduction of the contact pitch to increase the package density without regard to the type of the connector has been demanded.

It is an object of the present invention to provide a surface mount connector for a flexible printed circuit board which allows the provision of contacts at a smaller pitch and which is of low profile (low height).

It is another object of the present invention to provide a surface mount connector for the flexible printed circuit board which permits automatic insertion of a connector body (insulator) and a slider.

In order to achieve the above objects, the present invention provides a connector comprising an insulator, a plurality of contacts aligned longitudinally of said insulator and a slider, characterized in that said contacts are provided in said insulator with at least one end thereof and a portion of a central area thereof being exposed outward and said slider holds a flexible printed circuit board between said slider and said insulator, longitudinal opposite ends of said slider are connected to opposite ends of said insulator and said contacts are electrically connected to a conductive pattern of said printed circuit board at positions corresponding to a node of said slider.

SUMMARY OF THE INVENTION

The connector of the present invention fixes the opposite ends of the slider and the insulator while holding the flexible printed circuit board between the slider and the insulator, and electrically connects the contacts to the conductive pattern of the printed circuit board at the positions corresponding to the node of the slider. Thus, the package height is lower and the contact pitch is smaller than those of the prior art surface mount connector and the overall shape of the connector is reduced.

Because of the above construction, the present connector eliminates an actuator (operation lever) as compared with the prior art connector, for example, the ZIF connector, and the construction is simpler and operability is better (allowing the automatic packaging).

In the connector of the present invention, the contacts extends in the opposite directions from the opposite sides along the longitudinal direction. Thus, tandem connection of flexible printed circuit boards may be attained by connecting separate flexible circuit boards to the contact lines of the respective sides.

Further, by providing holes or notches at appropriate positions of the flexible printed circuit board, the slider per se may be directly contacted to the contact to ground it, which is an advantage not attained in the prior art structure.

BRIEF DESCRIPTION OF THE DRAWING FIGURES

DETAILED DESCRIPTION OF THE PREFERRED EMBODIMENT(S)

FIGS. 1A to 3C show one embodiment of the present invention. The present embodiment is explained with reference to the drawings.

The connector of the present invention comprises an insulator (connector body) 10, a plurality of contacts 20 aligned longitudinally of the insulator and a slider 30.

Figure 1A:
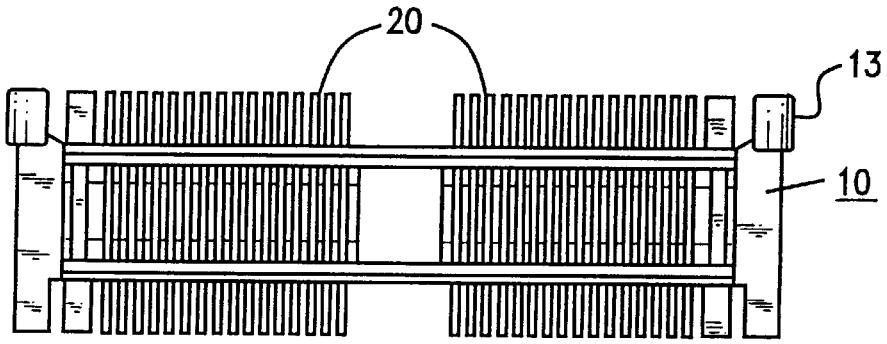
FIG. 1A shows a plan view of an insulator of a connector in accordance with a first embodiment of the present invention.
Figure 1B:
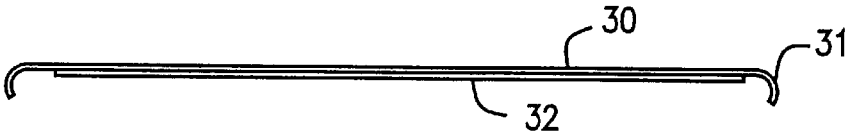
FIG. 1B shows a front view of a slider of the connector in accordance with the first embodiment.
Figure 1C:
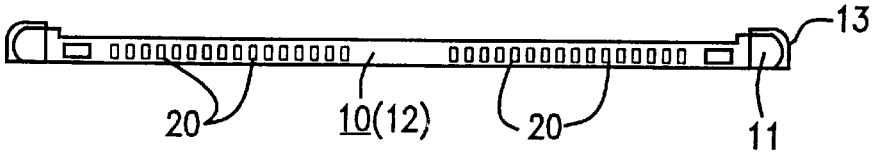
FIG. 1C shows a front view of the insulator of the connector in accordance with the first embodiment.

As will be described later, the insulator 10 comprises opposite ends 11 held by the slider 30 and a central area 12 for fixing a number of contacts 20 by molds. The material thereof is glass reinforced thermoplastic resin. As shown in FIGS. 1A and 2A, steps 13 are formed at the opposite ends 11 of the insulator 10 to regulate the movement by the slider 30 to unidirection (an open side free of step).

The contacts 20 are provided in the insulator 10 with at least one of ends thereof and a portion of a central area being exposed outward. In a hatched area shown in FIG. 2A, the contacts 20 are packaged (buried) in the contact body. As seen from FIG. 2A, the contacts 20 are formed such that a portion of the exposed central area thereof protrudes outward.

As shown in FIG. 1A, the plurality of contacts 20 are arranged to extend outward from a pair of sides which extend parallely to the longitudinal direction of the insulator 10. As shown, the width of the contact at the opposite ends may be widened to use for a power line or ground line.

Figure 2C:
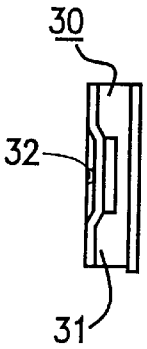
FIG. 2C shows a longitudinal sectional view of the slider in accordance with the first embodiment.
Figure 2B:
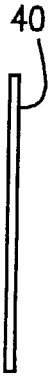
FIG. 2B shows a longitudinal sectional view of a flexible printed circuit board connected by the connector of the first embodiment.
Figure 2A:
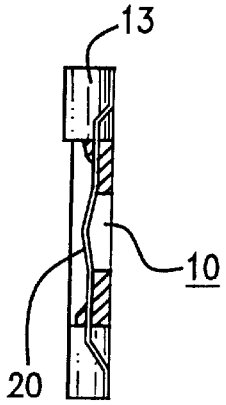
FIG. 2A shows a longitudinal sectional view of the insulator of the connector in accordance with the first embodiment.

The slider 30 is formed of a metal and a node 32 thereof is reduced inside as seen from FIG. 2C and holds the flexible printed circuit board 40 between the slider and the insulator 10. The longitudinal ends 31 of the slider are connected to the opposite ends 11 of the insulator and the contacts 20 are electrically connected to a conductive pattern of the printed circuit board at a position corresponding to the node of the slider 30.

In the illustrated embodiment, the longitudinal ends 31 of the slider 30 are formed to be bent inward (see FIGS 1B, 2C and 3C) and the longitudinal ends 11 of the insulator 10 are formed with curved surfaces corresponding to the shape of the ends of the slider 30. The slider 30 fixedly holds the opposite ends 11 of the insulator 10 relative to the insulator 10 at the longitudinal ends so that it is movable laterally. Specifically, the printed circuit board 40 temporarily held to a back side of the node by adhesive material is overlapped on the insulator 10 with the printed circuit board 40 being positioned down and the opposite ends 31 of the slider are pushed to fit the opposite ends 31 of the slider from the outside of the opposite ends 11 of the insulator. The contact 20 serves as a leaf spring and supports the printed circuit board 40 pushed in by the node of the slider 30.

Figure 3A:
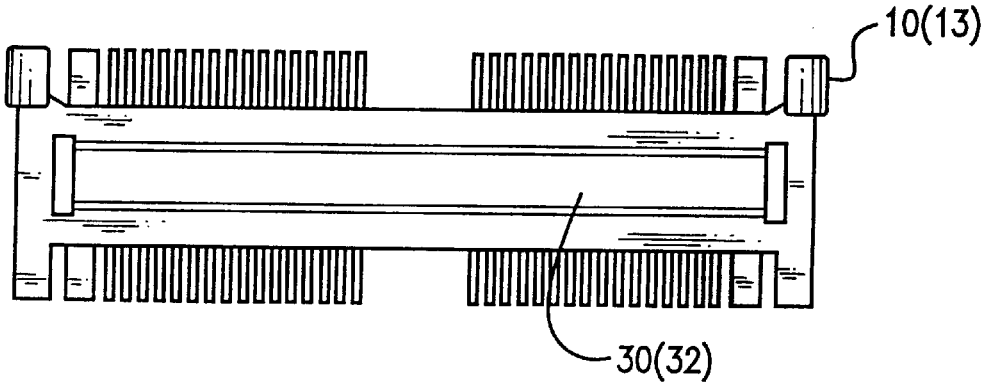
FIG. 3A shows a plan view of connection status of the connector in accordance with the first embodiment of the present invention.
Figure 3B:
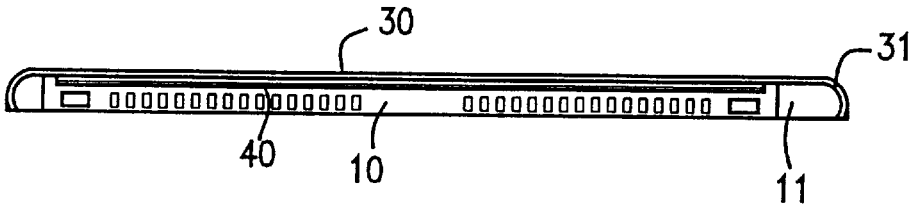
FIG. 3B shows a lateral sectional view of the connection status of the connector in accordance with the first embodiment.
Figure 3C:
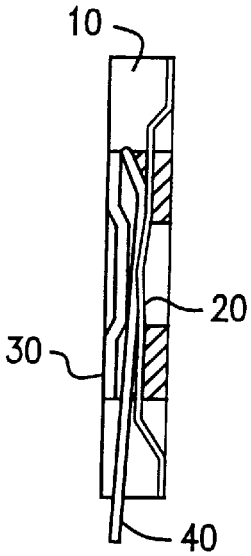
FIG. 3C shows a longitudinal sectional view of the connection status of the connector in accordance with the first embodiment

FIGS. 3B and 3C show the printed circuit board 40 but FIG. 3A does not show the printed circuit board for the sake of convenience. In the connector of the present invention, holes or notches are formed at appropriate positions of the flexible printed circuit board 40, and those contacts of the plurality of aligned contacts 20 which are located at the positions corresponding to the holes are directly contacted with slider 30.

In the connector of the present invention, the width of the flexible printed circuit board 40 is narrower than the distance between the opposite ends of the plurality of aligned contacts 20 and those contacts of the plurality of contacts 20 which are located at the ends may directly contacted with the slider (metal).

As shown in the embodiment, the contact 20 is not provided in the central area of the insulator 10 and a suction area for the automatic mounting may be provided to attain the automatic mounting of the main body and the slider.

Figure 4:
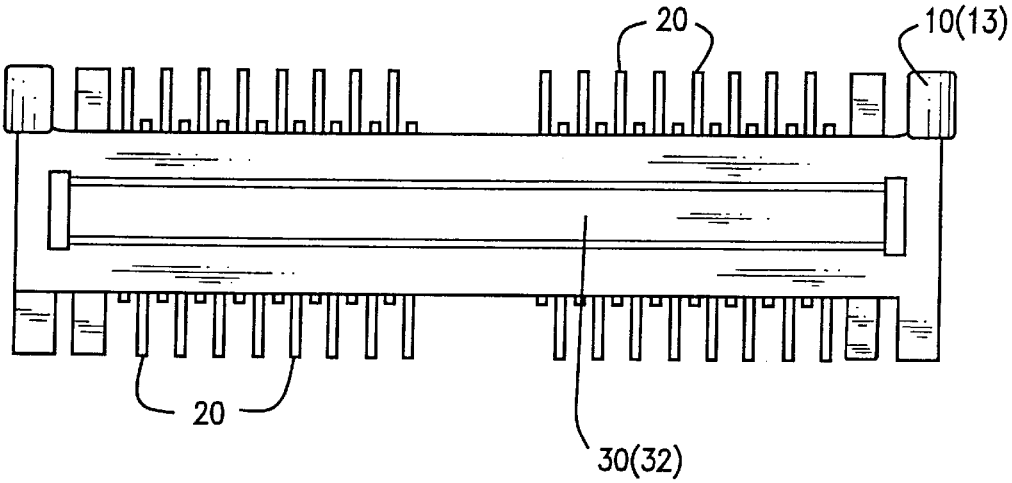
FIG. 4 shows a plan view of a connection status of a connector in accordance with a second embodiment of the present invention.

As shown in FIG. 4, the contact pitch may be widened by providing the plurality of contacts 20 to alternately extend outward from a pair of sides extending parallely to the longitudinal direction of the insulator 10.

What is claimed is:

1. An electrical connector comprising:

an elongate insulative connector body;

a plurality of elongate electrical contacts supported in longitudinal alignment within said connector body, said contacts having central portions exposed along said connector body; and a slider movably supported over said connector body for lateral sliding movement over said exposed central portions of said contacts, said slider supporting a flexible printed circuit board between said slider of said connector body for placing a conductive pattern of said flexible printed circuit board into electrical engagement with said central portions of said contacts upon said sliding movement of said slider.

2. An electrical connector of claim 1 wherein said central portions of said contacts protrude outwardly towards said slider forming deflectable leaf springs.

3. An electrical connector of claim 2 wherein said slider includes an elongated node in facing opposition to said connector body, said node urging said conductive pattern of said flexible printed circuit board into spring engagement with said central portions of said contacts upon said sliding movement of said slider.

4. An electrical connector of claim 1 wherein said longitudinal ends of said body include a curved surface and wherein said longitudinal ends of said slider are bent inwardly to conform to the shape of said ends of said body to facilitate said lateral sliding movement of said slider.

5. An electrical connector of claim 4 wherein said flexible printed circuit board includes holes at locations therealong, said holes permitting direct engagement between said slider and selected ones of said contact central portions aligned with said holes.

6. An electrical connector of claim 5 wherein said slider is a conductive member and wherein said slider and said selective ones of said contact central portions are placed in electrical engagement.

7. An electrical connector of claim 6 wherein said body is formed of a thermoplastic resin and said contacts are buried therein.

* * * * *